United States Patent [19]

Cupper et al.

[11] 4,097,393

[45] Jun. 27, 1978

[54] SILICONE-HYDROCARBON COMPOSITIONS

[75] Inventors: Robert Alton Cupper, Ridgefield, Conn.; Richard Welty Shiffler, Briarcliff Manor, N.Y.

[73] Assignee: Union Carbide Corporation, New York, N.Y.

[21] Appl. No.: 656,386

[22] Filed: Feb. 9, 1976

[51] Int. Cl.[2] ..... C10M 3/44; C10M 1/50

[52] U.S. Cl. ..... 252/78.3; 252/73

[58] Field of Search ..... 252/78, 49.6, 8.6, 73, 252/59, 78.3

[56] References Cited

U.S. PATENT DOCUMENTS

| | | | |
|---|---|---|---|
| 2,398,187 | 4/1946 | McGregor et al. | 252/78.3 |
| 2,398,943 | 4/1946 | Kollen | 252/73 |
| 2,466,642 | 4/1949 | Larsen | 252/49.6 X |
| 2,467,178 | 4/1949 | Zimmer et al. | 252/49.6 |
| 2,616,854 | 11/1952 | Fenske | 252/73 X |
| 2,618,601 | 11/1952 | Moreton | 252/49.9 |
| 2,652,364 | 9/1953 | Woods et al. | 252/49.6 X |
| 3,283,029 | 11/1966 | Brilland et al. | 252/73 X |
| 3,445,385 | 5/1969 | Vartanian | 252/49.6 X |
| 3,478,113 | 11/1969 | Bray et al. | 252/73 X |
| 3,725,280 | 4/1973 | Durr et al. | 252/59 |
| 3,766,285 | 10/1973 | Boggs et al. | 252/59 X |
| 3,793,207 | 2/1974 | Burrous | 252/78 |
| 3,816,316 | 6/1974 | Griffith et al. | 252/73 |
| 3,974,080 | 8/1976 | Coffman et al. | 252/78.3 |

FOREIGN PATENT DOCUMENTS

| | | |
|---|---|---|
| 507,713 | 11/1954 | Canada. |

OTHER PUBLICATIONS

Vinogradov et al., "Antiwear and Antifriction Properties of Polyorganosiloxanes and their Mixtures with Hydrocarbons", Wear, 8(12), 1965, pp. 93–111.

*Primary Examiner*—Harris A. Pitlick
*Attorney, Agent, or Firm*—Reynold J. Finnegan

[57] ABSTRACT

Silicone-hydrocarbon compositions of matter having utility as lubricants and hydraulic fluids, especially brake fluids.

5 Claims, No Drawings

SILICONE-HYDROCARBON COMPOSITIONS

BACKGROUND OF THE INVENTION

This invention relates to compositions of matter useful as lubricants and hydraulic fluids and more particularly to silicone-hydrocarbon compositions of matter which may be used as lubricants and in various hydraulic systems where extremes of temperatures are encountered such as in aircraft and automotive hydraulic systems.

Hydraulic fluids having good viscosity-temperature, viscosity-volatility and stability characteristics are very desirable. For instance, hydraulic fluids should in the broadest sense have viscosities high enough to satisfy the hydrodynamic requirements of the hydraulic pump and other elements of the hydraulic loop at the upper temperature extreme experienced and yet be low enough to flow freely at the lowest temperature expected. Attempts to attain such hydraulic fluids by the use of organosilicone materials have in general not proven particularly satisfactory. By way of illustration, silicone oils [i.e. materials having the formula $Me_3SiO(Me_2SiO)_xSiMe_3$] are not readily compatible with the elastomers ordinarily used in hydraulic systems. For instance, they tend to shrink SBR rubber gaskets often present in hydraulic systems which results in leakage of the silicone oil from the system. Silicone oils also have relatively poor lubricity for the metals conventionally used in hydraulic systems and hence relatively high wear is encountered when silicone oils are employed in such systems. Attempts to solve the disadvantages of such silicone oils by the addition thereto of conventional petroleum and other organic hydraulic fluids and/or the addition of conventional inhibitors such as anti-oxidants, rust and corrosion inhibitors, anti-wear agents, dispersants, and the like, have in general also not proven particularly successful since such silicone oils have exhibited very little ability if any to dissolve said conventional materials.

It has now been discovered that silicone-hydrocarbon compositions of matter can be prepared which are useful as lubricants and hydraulic fluids and which are superior to the use of such silicone oils per se as hydraulic fluids.

SUMMARY OF THE INVENTION

Therefore, it is an object of this invention to provide novel silicone-hydrocarbon compositions of matter which are useful as lubricants and hydraulic fluids. It is another object of this invention to provide a novel process that employs said silicone-hydrocarbon compositions of matter in a hydraulic system. Other objects and advantages of this invention will become readily apparent from the following description and appended claims.

More particularly this invention may be described as a composition of matter consisting essentially of (A) dimethyl siloxane oil having a viscosity of from about 10 to about 100 centistokes at about 25° C and consisting essentially of siloxy units of the formula $R_2SiO$ and end-blocking siloxy units of the formula $R_3SiO_{0.5}$ wherein R represents a methyl radical and (B) hydrocarbon oil having a Saybolt seconds universal viscosity at 100° F of from 30 to 500, said hydrocarbon oil being selected from the class consisting of naphthenic oils having a viscosity-gravity constant of at least 0.84, alkylated aromatic oils and branched chain aliphatic hydrocarbon oils wherein the branch chains contain one or two carbon atoms; wherein the proportions of components of (A) to (B) range from about 70:99 percent by volume of (A) to about 30:1 percent by volume of (B), and wherein said proportions of (A) and (B) are selected such that said components (A) and (B) remain miscible with each other at about −40° F for at least 72 hours.

DESCRIPTION OF THE PREFERRED EMBODIMENT

The dimethyl siloxane oils employed in this invention as well as methods for their preparation are well known and consist essentially of siloxy units of the formula $R_2SiO$ and end-blocking siloxy units of the formula $R_3SiO$ wherein R is a methyl radical. As employed herein such siloxane oils are essentially linear siloxane polymers having a viscosity in the range of about 10 to about 100 centistokes at about 25° C preferably about 50 to about 100 centistokes at about 25° C. Siloxane oils are also conventionally represented by the average formula $$R_3SiO(R_2SiO)_xSiR_3$$

wherein R is the same as defined above and $x$ is an integer having a value that corresponds to the viscosity of the particular siloxane. For example, a trimethyl end-blocked dimethylsiloxane oil having a viscosity of 100 centistokes at 25° C can be represented as having the average formula $$Me_3SiO(Me_2SiO)_{48}SiMe_3$$

wherein Me is a methyl radical.

It is to be understood, of course, that while the siloxane oils used in this invention can be discrete chemical compounds they are usually mixtures of various discrete siloxane species, due at least in part, to the fact the starting materials used to produce the siloxane oils are themselves usually mixtures. Thus, it is obvious that the siloxane oils employed herein need not be fractionated as by distillation but may be sparged (i.e. stripped of lites) or unsparged.

The hydrocarbon oils of the compositions of matter of this invention have a Sabolt seconds universal viscosity at 100° F of from 30 to 500 and may be selected from the class consisting of naphthenic oils having a viscosity-gravity constant of at least 0.84, alkylated aromatic oils and branched chain aliphatic hydrocarbon oils wherein the branch chains contain one to two carbon atoms.

Naphthenic oils that can be employed in this invention have a viscosity-gravity constant of at least 0.84 and are refined petroleum distillate fractions containing large proportions of naphthene ring carbons, i.e. 30–45% naphthene. Generally they will have aniline points ranging from about 135° to 185° F indicating a significant number of aromatic carbon atoms, i.e. about 10 to 30% aromatic. Such naphthenic petroleum oil fractions are well known in the art and are normally obtained by the conventional refining of fossil or synthetic crude oils, e.g. U.S. Southwest and Coastal naphthenic crudes, by atmospheric and/or vacuum distillation followed by solvent and/or hydrogen refining and solvent or low temperature solution dewaxing, if desired. Illustrative of the more preferred naphthenic oils that can be employed herein are those commercial oils like "Calumet" of the Calumet Refining Company, "Circosol" of Sun Oil Co., and "Necton" oils of the Exxon Company, and the like.

Alkylated aromatic oils that can be employed in this invention are synthesized aromatic hydrocarbon oils. Such alkylated aromatic oils are well known and are normally obtained by the alkylation of selected aromatic intermediates, e.g. by conventional alkylation via the well known Friedel-Crafts reaction. Illustrative alkylation agents are alphaolefins, chlorinated alkanes, alcohols, and the like having up to about 24 carbon atoms. Illustrative aromatic intermediates are benzene, alkyl-substituted benzenes, e.g. toluene, xylene, propyl substituted benzenes, butyl substituted benzenes, di-lauryl benzene, di-(mixed $C_{11}$ to $C_{15}$ alkyl) benzenes, bis-(di-tert butyl phenyl) methane, bis-(di-tert butyl phenyl) ethane, bis-(di-tert butyl phenyl)isopropane, and the like, as well as a aromatic mixture residues obtained in the commerical production of detergent alkylates. Other illustrative aromatic intermediates are naphthalene and various alkyl substituted naphthalenes where the alkyl group contains from 1 to 4 carbon atoms, e.g. methyl naphthalene, di- and tripropylnaphthalene, di-, tri- and tert-butyl naphthalenes, and the like, as well as the mixed naphthalene-methyl naphthalene refinery streams obtained in commercial pyrolysis processes for the manufacture of ethylene, propylene, acetylene, and the like. Illustrative of the more preferred alkylated aromatic oils that can be employed in this invention are hydrogenated and unhydrogenated propyl substituted naphthalenes such as commercial oils like "Kureha" of the Kureha Chemical Industry Company and more preferably mixed butylated methylnaphthalenes obtained by reacting the mixed naphthalene-methylnaphthalene refinery streams referred to above with isobutylene using a Friedel-Crafts type catalyst, such as "Panaflex BN-1" of the Amoco Chemical Company. For example, it is believed that "Panaflex BN-1" is a mixture of about 44 weight percent of di-butylmethylnaphthalenes, about 28 weight percent of methyltributylnaphthalene, about 15 weight percent of butylmethylnaphthalenes, 10 weight percent of butyldimethylnaphthalenes and about 2 weight percent of various isomeric butylnaphthalenes.

The branched-chain aliphatic hydrocarbon oils that can be employed in this invention are well known alkylates boiling in the preferred range of about 400° to 700° F. Such branched-chain hydrocarbon oils are those wherein the branch chains contain one to two carbon atoms, preferably one carbon atom and are commonly known as isoparaffinic oils. They can be produced by the conventional processes of alkylating $C_2$ to $C_5$ olefins with isoparaffins containing a teritary carbon atom and having 3 to 6 carbon atoms such as isobutane. They may also be prepared by the polymerization of selected olefins such as $C_2$ to $C_4$ mono-olefins. Polymerization conditions, i.e. temperature, pressure and catalyst, are selected so as to optimize the branching of the polymer chain to achieve good viscosity-temperature properties, while at the same time providing low pour points and good low temperature flow characteristics. Illustrative examples of such branched-chain hydrocarbon oils are polypropylene, $C_{18}$ to $C_{21}$ carbon atoms; polyisobutylene, $C_{12}$ to $>C_{40}$ carbon atoms, mol. wt. about 600 ("Oppanol B-1 of Badische Anilin und Soda-Fabrik, AG.); the polyisobutylene residue after stripping material boiling from 55° to 128° C. at 1 mm. pressure from said "Oppanol B-1"; and the like, as well as, 2, 2, 4, 4, 6, 8, 8-heptamethylnonane; 2, 6, 10, 14-tetramethylpentadecane, and the like. The most readily available source of branched-chain hydrocarbon oils that can be employed in this invention are mixed isoparaffin-naphthene hydrocarbon stocks obtained by the appropriate refining of petroleum fractions boiling within the range of about 400° to 700° F at atmospheric pressure, i.e. those obtained from the so-called gas-oil refining streams. Suitable refining normally includes the steps of (a) preliminary chemical treatment such as caustic scrubbing followed by acid neutralization and wax removal by conventional means, if necessary, (b) selective dearomatization by treatment with sulfuric acid or a catalytic hydrogen treatment, and (c) filtering using an ordinary clay-type filter media. Illustrative of the more preferred branched-chain hydrocarbon oils that can be employed by this invention are commerical isoparaffinic oils such as "Exxon 3146" and "Exxon 3147" of the Exxon Company, U.S.A. It should be pointed out that oils of this type are not exclusively isoparaffinic, i.e. they contain substantial quantities of naphthenic rings and in some cases, minor proportions of aromatic rings. It is known, however, that isoparaffinic hydrocarbon mixtures with relatively small proportions of cyclic structures can be made by the separation of the branched chain or isoparaffinic portions of mixed branched chain/straight chain hydrocarbon mixtures, as e.g. the hydrocarbon fraction of conventional petroleum kerosene fractions. Such separations may be made by the use of selected zeolite clays, e.g. Molecular Sieve 5A produced by the Linde Division of Union Carbide Corporation. Advantage may also be taken of the ability of n-paraffins to form addition products with urea or thiourea to effect the separation of branched chain and straight chain aliphatic hydrocarbons.

As pointed out above all three types of hydrocarbon oils employed in this invention are characterized by their Sabolt seconds universal viscosity at 100° F., (Ssu), while the naphthenic oils are further characterized by their VGC, (viscosity-gravity constant). The Sabolt seconds universal viscosity is measured by ASTM test method D88-56. The VGC concept for the characterization of petroleum lubricating oils was first published by J. B. Hill and H. B. Coats in "The Viscosity-Gravity Constant of Petroleum Lubricating Oils," *Industrial and Engineering Chemistry,* June 1968, P 641 and is now widely accepted procedure for the approximation of the degree of aromaticity or paraffinicity of a hydrocarbon. The viscosity-gravity constant employed herein is determined by ASTM test method D-2501-67 published in the 1973 Book of the American Society for Testing and Materials, Part 18. The VGC is relatively insensitive to molecular weight and is related to the proportion of naphthenic and aromatic structure in the oil. Values of VGC near 0.800 indicate a paraffinic character, where values close to 1.00 indicate a preponderance of aromatic structures.

Of course, it is understood that the compositions of matter of this invention encompass employing a single type of the above three defined types of suitable hydrocarbon oils (i.e. naphthenic oils, alkylated aromatic oils and branched-chain aliphatic hydrocarbon oils), employing a mixture of two or more different oils but of the same type (e.g. two different naphthenic oils, and the like) as well as employing a mixture of two or more different types of oils (e.g. a naphthenic oil and an alkylated aromatic oil, and the like). Generally it is preferred to employ a single type of hydrocarbon oil in a given composition, the naphthenic oils being the most preferred.

The silicone-hydrocarbon compositions of matter of this invention can be prepared in any conventional manner. Generally the two liquids need only be mixed together in the proportions desired while stirring at room temperature or slightly elevated temperatures. The proportions of silicone oil to hydrocarbon oil by volume in the compositions of matter of this invention can range from about 70 to about 99 percent by volume of silicone oil to about 30 to about 1 percent by volume of hydrocarbon oil and more preferably from about 90 to about 95 percent by volume of silicone oil to about 10 to about 5 percent by volume of hydrocarbon oil, with the proviso that said proportions of silicone oil and hydrocarbon oil are selected such that said two oils remain miscible with each other at about −40° F for at least 72 hours. the term "miscible" is used herein to mean that there is no development of either haze, separation or precipitation observed in the composition containing only the silicone oil and hydrocarbon oil during the prescribed storage period.

Of course, it is to be understood that not every possible hydrocarbon oil employed herein may be miscible for at least 72 hours at about −40° F. with every silicone oil employable herein having a viscosity from about 10 toabout 100 centistokes at about 25° C. Likewise it is to be understood that not every possible proportionate range by volume employable herein for every silicone oil and hydrocarbon oil component of this invention may result in a composition that is miscible for at least 72 hours at about −40° F. However, said Ssu viscosity and VGC values may serve as a general guideline to generically determine whether or not a particular hydrocarbon oil is suitable for use in the instant invention. In any event, the determination of same is well within the knowledge of one skilled in the art and can be readily determined by routine experimentation as taught herein. Moreover, with regard to naphthenic oils of the type called for by the instant invention for which VGC values may not be ascertainable due to the fact that their viscosities (Ssu, 100° F) are 38 or below, it is to be understood that if such oils result in a silicone-hydrocarbon composition of matter that is miscible for at least 72 hours at about −40° C then said hydrocarbon oils are considered for the purpose of this invention to have estimated VGC values of 0.84 or above and to be encompassed by the invention as defined and claimed herein.

The silicone-hydrocarbon composition of matter of this invention have good viscosity-temperature and viscosity-volatility stability characteristics and have a number of useful utilities. For example, they may be used as lubricants, hydraulic fluids, brake fluids, heat transfer fluids, shock absorber fluids, damping fluids, textile lubricants, mold release compounds and the like.

More preferably, the silicone-hydrocarbon compositions of matter of this invention may be employed as hydraulic fluids, especially brake fluids.

Accordingly, another aspect of this invention is a process for effecting movement of a movable member within enclosing chamber consisting of transmitting pressure to the movable member through a liquid medium comprising a silicone-hydrocarbon composition of matter of this invention defined above. More specifically another aspect of this invention is a process for transmitting force from the brake pedal means of a vehicle through hydraulic line means connected to master brake cylinder means and to activated means comprising filling said hydraulic means, said master cylinder means and said activated means with a silicone-hydrocarbon composition of matter of this invention as defined above.

Of course, it is to be understood that the specific type of hydraulic system or brake system is not critical and need not be described herein. Such systems are conventional and well known and the purpose of the present invention is not to define any particular novel mechanical system but to describe novel compositions of matter that are useful as lubricants and hydraulic fluids, especially, automotive brake fluids.

It is to be further understood that the silicone-hydrocarbon compositions of matter of this invention, if desired, can contain other conventional additives in the conventional used quantities commonly employed in hydraulic fluids, brake fluids, and the like, such as antioxidants, rust and corrosion inhibitors, anti-wear agent, dispersants, and the like.

The properties of typical naphthenic, branched chain aliphatic hydrocarbon and alkylated aromatic oils (that can be employed in this invention) as well as typical paraffin oils (that are not employed in this invention), which oils are used in the following examples, are reported in the following Table. The abreviations for said properties used in said Table and in the following Examples are as follows:

| Abreviation | Meaning |
|---|---|
| API. Gr. | American Petroleum Institute, Gravity as measured by ASTM D-287-64 |
| ° F | Degree Fahrenheit |
| Sp. Gr. | Specific Gravity |
| Ssu | Saybolt Seconds Universal as Measured by ASTM D88-56 |
| AP | Aniline Point as Measured by ASTM D11-64 |
| VGC | Viscosity Gravity Constant as Measured by ASTM D-2501-67 |
| SP | Solubility Parameter which is equal to VGC/AP $\times 10^{-3}$ |

TABLE I

| | API Gr. 60°/60° F | Sp. Gr. 60°/60° F. | Viscosity Ssu. 100° F | AP° F | VGC | SP |
|---|---|---|---|---|---|---|
| Hydrocarbon Oil | | | | | | |
| [1]Calcumet 3800 | 29.5 | 0.8789 | 38 | 138 | — | — |
| [1]Calumet 4500 | 29.0 | 0.8816 | 45 | 153 | 0.8640 | 5.64 |
| [1]Calumet 5400 | 28.0 | 0.8871 | 54 | 162 | 0.8613 | 5.32 |
| [1]Calumet 100 Pale | 26.5 | 0.8956 | 105 | 182 | 0.8862 | 4.86 |
| [2]MacMillan 80/90 | 22.9 | 0.9165 | 85 | 145 | 0.8846 | 6.10 |
| [3]Circosol 306 | 26.4 | 0.8961 | 58 | 138 | 0.8646 | 6.26 |
| [3]Circosol 407 | 23.5 | 0.9129 | 70 | 144 | 0.8841 | 6.14 |
| [3]Circosol 410 | 22.2 | 0.9206 | 108 | 147 | 0.8872 | 6.04 |
| [3]Circo Light RPO | 22.4 | 0.9194 | 156 | 163 | 0.8786 | 5.39 |
| [3]Circosol 450 | 19.6 | 0.9365 | 515 | 162 | 0.8858 | 5.46 |

TABLE I-continued

| | API Gr. 60°/60° F | Sp. Gr. 60°/60° F. | Viscosity Ssu. 100° F | AP° F | VGC | SP |
|---|---|---|---|---|---|---|
| [3]Circosol 4240 | 17.6 | 0.9490 | 2525 | 172 | 0.8841 | 5.14 |
| Isoparaffinic Oils | | | | | | |
| [4]Exxon 3146 | 35.6 | 0.8468 | 35.8 | 160 | — | — |
| [4]Exxon 3147 | 30.4 | 0.8740 | 55.9 | 180 | 0.8452 | 4.69 |
| Alkylated Aromatic Oils | | | | | | |
| [5]Kureha AA-1 | 17.0 | 0.9529 | 37.1 | −0.5 | — | — |
| [5]Kureha AA-2 | 16.8 | 0.9541 | 48.3 | −20 | 0.9409 | — |
| [6]Panaflex BN-1 | 18.0 | 0.9465 | 230 | 15 | 0.9086 | — |
| Paraffin Oils | | | | | | |
| [4]Exxon 75N | 35.1 | 0.8493 | 75 | 213 | 0.8073 | 3.79 |
| [7]Citgo 100N | 33.0 | 0.8602 | 105 | 221 | 0.8122 | 3.68 |
| [8]Farmland 100N | 33.0 | 0.8602 | 105 | 218 | 0.8122 | 3.72 |
| [7]Citgo 200N | 30.5 | 0.8735 | 205 | 230 | 0.8158 | 3.54 |
| [9]Pennzoil 150 Bright | 26.5 | 0.8956 | 2350 | 255 | 0.8042 | 3.15 |

Footnotes of TABLE I
[1]Calumet Refining Company
[2]MacMillan Oil Company Inc.
[3]Sun Oil Company
[4]Exxon Company, U.S.A.
[5]Kureha Chemical Industry Company
[6]Amoco Chemical Company
[7]Cities Service Oil Company
[8]Farmland Industries, Inc.
[9]Pennzoil United, Inc.

The following Examples illustrate the present invention.

EXAMPLES 1-21

A series of silicone-hydrocarbon compositions of matter were prepared by blending various hydrocarbon oils of TABLE I above with trimethyl end-blocked siloxane oils. Each blend was a 25 milliliter mixture while the volume ratios of said oils were varied as was the viscosity of the siloxane oils. The various blended samples were then stored for 72 hours at room temperature (RT), 0° F and −40° F after which they were observed for the development of haze, separation and precipitation. If none of these phenomena were observed the hydrocarbon oil was considered to be miscible (M) in the silicone oil. If any one of these phenomena was observed, the hydrocarbon oil was considered to be immiscible (IM) in the silicone oil. The results of said tests are reported in the following TABLE II.

Blend A is a mixture of 95 percent by volume of trimethyl end-blocked dimethylsiloxane oil having a viscosity of 100 centistokes (cs.) at 25° C and 5 percent by volume of the hydrocarbon oil.

Blend B is a mixture of 90 percent by volume of trimethyl end-blocked dimethylsiloxane oil having a viscosity of 100 centistokes at 25° C and 10 percent by volume of the hydrocarbon oil.

Blend C is a mixture of 70 percent by volume of trimethyl end-blocked dimethylsiloxane oil having a viscosity of 100 centistokes at 25° C and 30 percent by volume of the hydrocarbon oil.

Blend D is a mixture of 95 percent by volume of trimethyl end-blocked dimethylsiloxane oil having a viscosity of 50 centistokes at 25° C and 5 percent by volume of the hydrocarbon oil.

Blend E is a mixture of 70 percent by volume of trimethyl end-blocked dimethylsiloxane oil having a viscosity of 50 centistokes at 25° C and 30 percent by volume of the hydrocarbon oil.

Blend F is a mixture of 95 percent by volume of trimethyl end-blocked dimethylsiloxane oil having a viscosity of 10 centistokes at 25° C and 5 percent by volume of the hydrocarbon oil.

Blend G is a mixture of 90 percent by volume of trimethyl end-blocked dimethylsiloxane oil having a viscosity of 10 centistokes at 25° C and 10 percent by volume of the hydrocarbon oil.

Blend H is a mixture of 70 percent by volume of trimethyl end-blocked dimethylsiloxane oil having a viscosity of 10 centistokes at 25° C and 30 percent by volume of the hydrocarbon oil.

TABLE II

| | | Siloxane 100 cs. | | | | | | | | | Siloxane 50 cs. | | | | | |
|---|---|---|---|---|---|---|---|---|---|---|---|---|---|---|---|---|
| Ex. | Hydrocarbon | Blend A (95/5) | | | Blend B (90/10) | | | Blend C (70/30) | | | Blend D (95/5) | | | Blend E (70/30) | | |
| No. | Oil | RT | 0° F | −40° F | RT | 0° F | −40° F | RT | 0° F | −40° F | RT | 0° F | −40° F | RT | 0° F | −40° F |
| | Naphthenic Oils | | | | | | | | | | | | | | | |
| 1 | Calumet 3800 | | | | | | | M | M | M | | | | | | |
| 2 | Calumet 4500 | | | | | | | M | M | M | | | | | | |
| 3 | Calumet 5400 | | | | M | M | M | M | M | IM | M | M | M | M | M | M |
| 4 | Calumet 100 Pale | M | M | M | M | IM | IM | IM | | | | | | M | IM | |
| 5 | MacMillan 80/90 | | | | IM | IM | IM | IM | | | M | M | IM | IM | | |
| 6 | Circosol 306 | M | M | M | | | | M | M | IM | | | | M | M | IM |
| 7 | Circosol 407 | M | M | M | | | | M | M | IM | | | | M | M | IM |
| 8 | Circosol 410 | M | M | M | M | M | IM | IM | | | M | M | IM* | M | IM | |
| 9 | Circo Light RPO | M | M | M | M | IM | | IM | | | | | | IM | | |
| 10 | Circosol 450 | IM | | | IM | | | | | | M | M | IM | | | |
| 11 | Circosol 4240 | IM | | | | | | | | | M | IM | | | | |
| | Alkylated Aromatic Oils | | | | | | | | | | | | | | | |
| 12 | Kureha AA-1 | | | | M | M | M | M | M | | | | M | M | IM | |
| 13 | Kureha AA-2 | | | | M | M | M | M | IM M | IM | | | | M | M | IM |

TABLE II-continued

| | | | | | | | | | | | | | | |
|---|---|---|---|---|---|---|---|---|---|---|---|---|---|---|
| 14 | Panaflex BN-1 | | | | M | M | M | M | M | M | | | | |
| | Isoparaffinic Oils | | | | | | | | | | | | | |
| 15 | Exxon No. 3146 | M | M | M | | | | M | M | IM | | | | |
| 16 | Exxon No. 3147 | M | M | M | | | | M | M | IM | | | | |
| | Paraffinic Oils | | | | | | | | | | | | | |
| 17 | Exxon 75N | M | M | IM | M | M | IM | M | IM | IM | | | | |
| 18 | Citgo 100N | M | M | IM | M | M | IM | IM | | | M | M | IM | IM |
| 19 | Farmland 100N | M | IM | IM | IM | | | | | | M | IM | | |
| 20 | Citgo 200N | M | M | IM | IM | | | | | | M | M | IM | |
| 21 | Pennzoil 150 Bright | | | | | | | | | | | | | |

| | | Siloxane 10 cs. | | | | | | | | |
|---|---|---|---|---|---|---|---|---|---|---|
| | | Blend F (95/5) | | | Blend G (90/10) | | | Blend H (70/30) | | |
| Ex. No. | Hydrocarbon Oil | RT | 0° F | −40° F | RT | 0° F | −40° F | RT | 0° F | −40° F |
| | Naphthenic Oils | | | | | | | | | |
| 1 | Calumet 3800 | | | | | | | | | |
| 2 | Calumet 4500 | | | | | | | | | |
| 3 | Calumet 5400 | | | | | | | M | M | M* |
| 4 | Calumet 100 Pale | | | | | | | | | |
| 5 | MacMillan 80/90 | M | M | IM* | | | | M | M | IM |
| 6 | Circosol 306 | | | | | | | M | M | IM |
| 7 | Circosol 407 | | | | | | | M | M | IM |
| 8 | Circosol 410 | | | | | | | | | |
| 9 | Circo Light RPO | | | | | | | M | M | IM |
| 10 | Circosol 450 | | | | M | M | IM | M | IM | |
| 11 | Circosol 4240 | | | | | | | | | |
| | Alkylated Aromatic Oils | | | | | | | | | |
| 12 | Kureha AA-1 | | | | | | | M | M | M |
| 13 | Kureha AA-2 | | | | | | | M | M | IM |
| 14 | Panaflex BN-1 | | | | M | M | M | M | M | M |
| | Isoparaffinic Oils | | | | | | | | | |
| 15 | Exxon No. 3146 | | | | | | | | | |
| 16 | Exxon No. 3147 | | | | | | | | | |
| | Paraffinic Oils | | | | | | | | | |
| 17 | Exxon 75N | M | M | IM | M | M | IM | M | M | IM |
| 18 | Citgo 100N | M | M | | | | | M | M | IM |
| 19 | Farmland 100N | M | M | IM | M | M | IM | M | M | IM |
| 20 | Citgo 200N | M | M | IM | | | | | | |
| 21 | Pennzoil 150 Bright | IM | | | | | | | | |

The above data shows that the silicone-hydrocarbon compositions of matter of this invention are miscible at −40° F for at least 72 hours over a wide liquidus range. Experience has shown that compositions which are miscible for at least 72 hours will normally remain miscible over the service life of said compositions. Inspection of the date in TABLE II shows a large number of empty spaces in the various columns. These blends were not tested because the demonstration of miscibility of compositions containing a higher viscosity siloxane oil made it unnecessary to examine analogous blends containing lower viscosity siloxane oils. Those results shown as M* indicate a borderline miscibility rating, i.e., a very slight haze was observed which is believed due to contaminates, e.g., water, in the composition rather than the compositions components themselves. Those results shown as IM* indicate a borderline immiscibility rating, i.e. a slight haze was observed which may be due to contaminates, but is believed to have been caused by the composition components.

In the Example appearing below, the following SAE (Society of Automotive Engineers) J 1703 test procedures were used.

SBR Rubber Swell Test — A brake cylinder cup made of SBR rubber (styrene-butadiene rubber) is immersed in 75 milliliters of the fluid being tested and the fluid is then heated for 70 hours at 248° F. The diameter of the cup is measured before and after the test. The fluid is considered to have passed this test if the change in cup diameter is between 0.006 and 0.055 inch.

Stroke Test — The fluid being tested is used as the hydraulic fluid in a brake system operated at 1000 strokes per hour at 248° F for a total of 85,000 strokes.

Lip Diameter Test — The diameter of the SBR rubber cup is measured before and after the Stroke Test described above. The lip diameter interference set of the rubber cup is then calculated according to the equation:

$$S = \frac{D_1 - D_2 \times 100}{D_1 - D_3}$$

wherein S is the set, $D_1$ and $D_2$ are the initial and final rubber cup diameters respectively and $D_3$ is the original brake cylinder bore diameter. This fluid is considered to have passed this test when the set does not exceed 65%.

Viscosity — The viscosity of the fluid being tested is measured at −40° F. The fluid is considered to have passed this test when its viscosity is no greater than 1800 centistokes at −40° F.

EXAMPLE 22

A composition of matter (hereinafter referred to as Blend I) consisting of 7.5 percent by weight (about 8.2% volume) of Calumet 5400 (a naphthenic oil) and 92.5 percent by weight (about 91.8% by volume) of a trimethyl end-blocked dimethylsiloxane oil having a viscosity of 100 centistokes at 25° C was prepared.

This silicone-hydrocarbon composition (Blend I) was found to exhibit an SBR rubber swell of 0.030 inches (SAE specification limit, 0.006 to 0.055 inches) and a −40° F viscosity of 500 centistokes (SAE limit, 1800 centistokes maximum).

Moreover, said Blend I was found to provide improved lubricating properties over the neat 100 centistoke (25° C) viscosity trimethyl end-blocked dimethylsiloxane oil in the SAE simulated service performance test (Stroke Test). Blend I showed normal wear of the wheel cylinder pistons and a brake wheel cyclinder rubber cup lip diameter interference of zero percent, while the comparative neat 100 centistokes (25° C) viscosity trimethyl end-blocked dimethylsiloxane oil caused excessive wheel cylinder wear and gave a brake wheel cylinder rubber cup lip diameter interference of 67 percent. The SAE requirement for brake wheel cylinder cup lip diameter interference is 65 percent maximum change.

EXAMPLES 23–29

A series of silicone-hydrocarbon compositions of matter (hereinafter referred to as Blends J to P) were prepared by blending various branched chain aliphatic hydrocarbon oils with a trimethyl end-block dimethylsiloxane oil having a viscosity of 100 centistokes (cs) at 25° C. Each blend was a 15 milliliter mixture of 70 percent by volume of said siloxane oil and 30 percent by volume of the hydrocarbon oil.

The hydrocarbon oil of Blend J was 2, 2, 4, 4, 6, 8, 8-heptamethylnonane having a Ssu. viscosity at 100 ° F of 36.8, a Sp. Gr. (60°/60° F) 0.798.

The hydrocarbon oil of Blend K was 2, 6, 10, 14-tetramethylpentadecane having a Ssu. viscosity at 100° F of 41.90, a Sp. Gr. (60°/60° F) of 0.781 and a VGC of 0.762.

The hydrocarbon oil of Blend L was polypopylene, $C_{18}$–$C_{21}$ carbon atoms, having a Ssu. viscosity at 100° F of 32.70 and a Sp. Gr. (60°/60° F) of 0.774.

The hydrocarbon oil of Blend M was polyisobutylene, $C_{12}$ to $>C_{40}$ carbon atoms, mol. wt. about 600 ("Oppanol B-1") having a Ssu. viscosity at 100° F of 69.42, a Sp. Gr. (60°/60° F) of 0.825 and a VGC of 0.781.

The hydrocarbon oil of Blend N was the polyisobutylene residue (>40 carbon atoms) after stripping material boiling from 55° to 128° C. at 1mm pressure from said "Oppanol B-1", said residue having a Ssu. viscosity at 100° F of 91.70.

The hydrocarbon oil of Blend O was an isoparaffinic fraction derived from kerosene having a Ssu. viscosity at 100° F of 28.8 and aniline point of 153° F.

The hydrocarbon oil of Blend P was a polypropylene residue after lites had been stripped off having a Ssu. viscosity at 100° F of 279.9 and a Sp. Gr. (60°/60° F) of 0.842.

Each of the various blended samples were then stored for 72 hours at 0° F and −40° F after which they were observed for the development of haze, separation and precipitation. If none of these phenomena were observed the hydrocarbon oil was considered to be miscible in the silicone oil. The results of said tests are reported in the following TABLE III.

TABLE III

| Ex. No. | Blend | Room Temperature | 0° F | −40° F |
|---|---|---|---|---|
| 23 | J | Miscible | Miscible | Miscible |
| 24 | K | Miscible | Miscible | Micsible |
| 25 | L | Miscible | Miscible | Miscible |
| 26 | M | Immiscible (Cloudy) | Immiscible (Hazy) | Immiscible (Hazy) |
| 27 | N | Immiscible (Cloudy) | Immiscible (Cloudy) | Immiscible (Cloudy) |
| 28 | O | — | Miscible | Immiscible |
| 29 | P | Immiscible | Immiscible | Immiscible |

Various modifications and variations of this invention will be obvious to a worker skilled in the art and it is to be understood that such modifications and variations are to be included within the purview of this application and the spirit and scope of the appended claims.

What is claimed is:

1. A composition of matter consisting essentially of (A) dimethyl siloxane oil having a viscosity of from about 10 to about 100 centistokes at about 25° C and consisting essentially of siloxy units of the formula $R_2SiO$ and end-blocking siloxy units of the formula $R_3SiO_{0.5}$ wherein R represents a methyl radical, and (B) naphthenic oil having a Saybolt seconds universal viscosity at 100° F of from 30 to 500, and a viscosity-gravity constant of at least 0.84; wherein the proportions of components of (A) to (B) ranges from about 70:99 percent by volume of (A) to about 30:1 percent by volume of (B), and wherein said proportions of (A) and (B) are selected such that said components (A) and (B) remain miscible with each other at about −40° F for at least 72 hours.

2. A composition of matter as defined in claim 1, wherein the proportions of components (A) to (B) range from about 90 to about 95 percent by volume of (A) to about 10 to 5 percent by volume of (B).

3. A composition of matter as defined in claim 2, wherein the trimethyl end-blocked dimethylsiloxane oil has a viscosity of about 50 to about 100 centistokes at 25° C.

4. A process effecting movement of a movable member within an enclosing member which consists in transmitting pressure to said movable member through a liquid medium consisting essentially of a composition of matter as defined in claim 1.

5. A process for transmitting force from the brake pedal means of a vehicle through hydraulic line means connected to master brake cylinder means and to activated means comprising substantially filling said hydraulic means, said master brake cylinder means and said activated means with a composition of matter as defined in claim 1.

* * * * *